United States Patent [19]

Jantzen

[11] 4,353,311

[45] Oct. 12, 1982

[54] RAILWAY CAR CENTER PLATE ASSEMBLY

[75] Inventor: Steven L. Jantzen, St. Charles, Mo.

[73] Assignee: ACF Industries, Incorporated, New York, N.Y.

[21] Appl. No.: 199,146

[22] Filed: Oct. 22, 1980

[51] Int. Cl.[3] ..... B61F 3/00

[52] U.S. Cl. ..... 105/199 C; 105/413

[58] Field of Search ..... 105/413, 199 R, 199 C, 105/199 CB

[56] References Cited

U.S. PATENT DOCUMENTS 2,219,286 10/1940 Anderson et al. ..... 105/413

4,166,520 9/1979 Baker et al. ..... 105/413

*Primary Examiner*—Richard A. Bertsch

*Attorney, Agent, or Firm*—Harry W. Cummings

[57] ABSTRACT

In accordance with the invention a center filler assembly is inserted into a railway car center sill and is permanently attached to the center sill. The center filler includes longitudinally spaced vertical plates which extend between the walls of the center sill. Spacer extensions integral with the vertical plates extend beyond the walls of the center sill and abut the bottom surface of the center sill flanges. A mounting plate extends longitudinally of the car between the center filler vertical plates. A wear member in adopted to be located in the truck bowl. Interengaging means are provided to removably lock the wear member is engagement with the mounting plate. This interengaging means preferably comprises slots in the wear member which engage the spacer extensions integral with the vertical plates.

12 Claims, 1 Drawing Figure

RAILWAY CAR CENTER PLATE ASSEMBLY

BACKGROUND OF THE INVENTION

Figure 1:
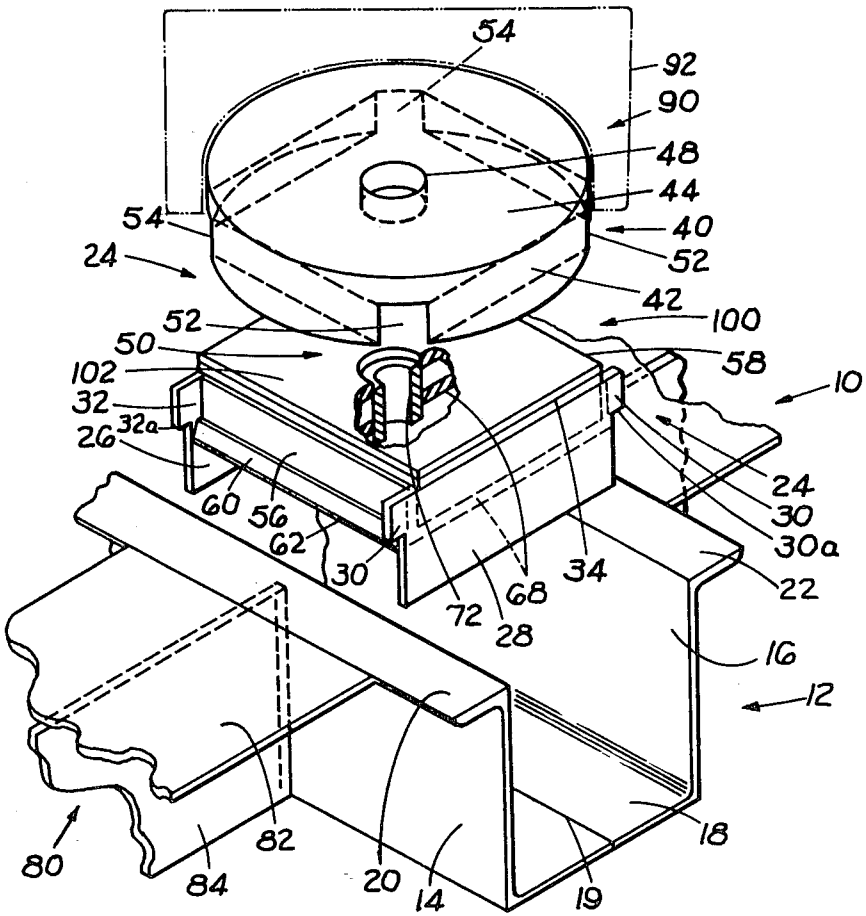

U.S. Pat. No. 3,664,269 discloses a center plate assembly in which a pair of longitudinally spaced plates are welded to the center sill to define a rectangular pocket. A center plate member includes an upper top portion which extends into the pocket and a base portion which is larger than the pocket and rests in the truck bowl. The base portion is welded to the edges of the pocket to form an integral assembly.

However, if the center plate member must be replaced, the welds between the center plate member and the pocket must be burned out. This causes damage to center sill, the spaced plates and to the center plate member.

U.S. Pat. No. 4,174,140 discloses an elastomeric member located between a laterally foreshortened car body member and a railway truck bowl. The patent states that the elastomeric member carries both vertical and horizontal loads between the car body and the truck. U.S. Pat. No. 4,213,400 discloses a railway car center plate assembly including a laterally foreshortened car body member and an elastomeric pad bonded to the car body member and to a wear plate located in the truck bowl. However this construction requires a nonstandard, specially formed, laterally foreshortened car body member which is not currently in use in the railway industry.

One object of the present invention is to provide a railway car centerplate assembly which does not require modification of the standard car body members on the truck bowl.

Another object of the invention is to provide a railway car center plate assembly including a wear member located in the truck bowl wherein the wear member can be replaced without burning out the center plate member from the center sill.

SUMMARY OF THE INVENTION

In accordance with the invention a center filler assembly is inserted into a railway car center sill and is permanently attached to the center sill. The center filler includes longitudinally spaced vertical plates which extend between the walls of the center sill. Spacer extensions integral with the vertical plates extend beyond the walls of the center sill and abut the bottom surface of the center sill flanges. A mounting plate extends longitudinally of the car between the center filler vertical plates. A wear member is adopted to be located in the truck bowl. Interengaging means are provided to removably lock the wear member in engagement with the mounting plate. This interengaging means preferably comprises slots in the wear member which engage the spacer extensions integral with the vertical plates.

On either side of the mounting extension, transversely of the center sill the support plates are tapered upwardly to abut the center sill vertical walls. The flange portions of the center sill are preferably coped or chamfered to define inclined welding slots.

The center filler also preferably includes a backing plate attached to the upper surface mounting plate. Additional reinforcing means such as a channel may be connected to the backing plate to insure a rugged construction to withstand the coupling impact loads.

A body bolster preferably includes a lower cover plate which abuts and is welded to the flanges on either side of the center sill. In addition one or more vertical webs of the bolster abut the vertical walls of the center sill and are welded thereto.

The wear member is generally cylindrical to fit within the truck bowl. The lower surface is flat. The wear member is made of metal.

A thin layer of elastomeric material is provided between the mounting plate and the wear member to transmit loads more uniformly between the metal mounting plate and the metal wear member. As an example, an elastomeric epoxy coating may be applied to the mounting plate and the metal wear member. After curing the epoxy coating is firmly attached to the metal wear plate and to the mounting plate, and is effective to transmit vertical loads and horizontal loads between the truck and car body.

Alternatively a thin layer of elastomeric material may be placed between the mounting plate and the wear member which is not bonded to either member.

IN THE DRAWINGS

FIG. 1 is a schematic perspective view of the center plate assembly of the present invention, with the center sill and center plate assembly extending rotated 180° to an upstanding position for clarity.

DESCRIPTION OF PREFERED EMBODIMENTS

The center plate assembly of the present invention is indicated in the drawings generally at 10. A center sill 12 includes vertical webs 14 and 16 and a horizontal portion 18. In horizontal portion 18 a weld line 19 is provided. Each of the vertical webs 14 and 16 include horizontal flanges 20 and 22. A center filler 24 includes a pair of longitudinally spaced plates 26 and 28. These plates 26 and 28 are to be inserted within the center sill 12 and welded to web portions 14 and 16.

Plates 26 and 28 include spacer extensions 30 and 32 on each end. These spacer extensions are adopted to engage the center sill flanges 20 and 22 on their lower surfaces **30*a* and 32*a*. The spacer extensions 30 and 32 are then welded to the respective flanges 20 and 22**.

A mounting plate 34 extends between vertical plates 26 and 28. The mounting plate 34 is generally flat and horizontal in the midportion thereof. Mounting plate 34 is adopted to receive a wear member indicated generally at 40. Wear member 40 includes a body portion 42 having a flat lower surface 44, and an opening 48 to receive the conventional king pin.

To insure effective engagement between the wear member 40 and the center filler 24, interengaging means indicated generally at 50 are provided between the wear member 40 and the center filler 24. This may comprise slots 52 and 54 on the wear member 40 into which fit the spacer extensions 30 and 32 and rotation therebetween is prevented. Thus it is seen that wear member 40 is rigidly but removably connected to mounting center filler 34.

A pair of vertical plates 56 and 58 extend upwardly on either side of plate 34. Short tapered plates 60 are inclined upwardly and outwardly. Tapered plates 60 terminate in an end portion 62 which is adopted to abut the inner wall of flanges 20 and 22. Welds are provided between tapered edges 62 and webs 14 and 16 to integrally connect walls 56–60 with the flanges 20 and 22 of center sill 12 and also vertical webs 14 and 16.

It thus is to be emphasized that the welds holding vertical plates 26 and 28 within the center sill along the vertical webs 14 and 16 and the welds holding tapered edges 60 in engagement with center sill flanges 20 and 22 and center sill webs 14 and 16 are strong welds. The center filler 24 is thus permanently connected to the center sill. It is not intended that this center filler would be removed once installed.

Center filler 24 further includes an upper support plate 68 which engages either end of tapered plates 60. In addition, a reinforcing channel 70 may be provided welded to plate 68 and to plate 34. Thus a strong rugged reinforced construction is provided within the center sill. A king pin support 72 is provided which is welded to plates 34 and 68 to support a conventional king pin.

A bolster 80 includes a flange portion 82 which abuts flange portions 20 and 22 of the center sill and is welded thereto. One or more vertical webs of the bolster 84 are also welded to the vertical webs 14 and 16 of the center sill. Thus the bolster is integrally connected to the center sill.

The wear member is adopted to be inserted within a conventional truck bowl indicated generally at 90. A truck bowl includes a flange portion 92 which engages the body portion 42 of the wear plate 40. The preferred material for a metallic wear plate is steel, however, aluminum and aluminum alloys of suitable strength may also be utilized.

Means 100 are provided to transmit the loads between wear member 40 and plate 34. This means comprises a layer or coating of elastomeric material 102. If a coating is used, it may be bonded to plate 34 and/or to wear member 40. As an example, an epoxy coating may be applied to wear member 40 and plate 34. The epoxy coating is provided of suitable thickness such that when cured it will cushion, particularly vertical loads, between wear member 40 and plate 34. However, coating 102 will also carry some horizontal loads.

Instead of a coating a layer of elastomeric material may be used which is not bonded to either member. This material should have sufficient strength to transmit vertical loads between the plate 34 and wear member 40, and can withstand loading for a long time without disintegrating. Examples are: an elastomeric urethane such as adiprene or high molecular weight polyethelene.

It is apparent that the elastomeric member is easily replaced when it becomes worn by simply lifting the car body of the truck sufficiently for the operator to effect disengagement between the wear member 40 and the plate 34.

The metal wear plate is also readily replaced in the same manner.

Somewhat more effort may be required to disconnect the epoxy which is bonded to the plate 34 and wear member 40 than when the layer 102 is not bonded to either member.

However, it is seen that both of these embodiments provide much improved replacement of the wear member as compared to the construction shown in U.S. Pat. No. 3,664,269 wherein the center plate member must be burned out with a flame torch from the pocket in the center sill.

Concerning U.S. Pat. No. 4,174,140 it is apparent that the construction of the present invention utilizes a standard center sill and standard bolster. The nonstandard laterally foreshortened car body member is not required in the assembly of the present invention.

What is claimed is:

1. A railway car center plate assembly comprising: a center filler assembly adopted to be inserted into a railway car center sill and permanently attached to the center sill; said center filler assembly including longitudinally spaced vertical plates which extend between the walls of the center sill; spacer extensions located below said vertical plates which extend beyond the walls of the center sill and abut the bottom surface of the center sill flanges; a mounting plate extending longitudinally of the car between said vertical plates; a wear member adopted to be located in the truck bowl; and interengaging means to removably lock said wear member in engagement with said mounting plate.

2. A railway car center plate assembly comprising: a center filler assembly adopted to be inserted into a railway car center sill and permanently attached to the center sill; said center filler assembly including longitudinally spaced vertical plates which extend between the walls of the center sill; spacer extensions located below said vertical plates which extend beyond the walls of the center sill and abut the bottom surface of the center sill flanges; a mounting plate extending longitudinally of the car between said vertical plates; a wear member adopted to be located in the truck bowl; and intermediate means comprising slots provided in said wear plate which engage said spacer extensions, to removably lock said wear member in engagement with said mounting plate.

3. A railway car center plate assembly according to claim 2, wherein on either side of the mounting plate support plates are tapered upwardly to abut the center sill flanges.

4. A railway car center plate assembly according to claim 2, wherein said center filler includes a backing plate attached to the upper surface of said mounting plate.

5. A railway car center plate assembly according to claim 4, including reinforcing means connected to the backing plate to insure a rugged construction to withstand the coupling impact loads.

6. A railway car center plate assembly according to claim 2, including a body bolster including a lower cover plate which abuts and is welded to the flanges of the center sill.

7. A railway car center plate assembly according to claim 6, wherein said bolster includes one or more vertical webs which abut the vertical walls of the center sill and are welded thereto.

8. A railway car center plate assembly according to claim 2, wherein said wear member is generally cylindrical to fit within the truck bowl and includes a lower surface which is flat.

9. A railway car center plate assembly according to claim 8, wherein the wear member is made of metal.

10. A railway car center plate assembly according to claim 9, wherein a thin layer of elastomeric material is provided between the mounting plate and the wear member to transmit loads more uniformly between the metal mounting plate and the metal wear member.

11. A railway car center plate assembly according to claim 10, wherein an elastomeric epoxy coating is applied to said mounting plate and/or the metal wear member.

12. A railway car center plate assembly according to claim 10, wherein said thin layer of elastomeric material lies between but is unbonded to said wear plate and said mounting plate.

* * * * *